US007372205B2

(12) United States Patent
Tessier

(10) Patent No.: US 7,372,205 B2
(45) Date of Patent: May 13, 2008

(54) PLASMA DISPLAY PANEL HAVING COPLANAR ELECTRODES WITH CONSTANT WIDTH

(75) Inventor: Laurent Tessier, Fontaine (FR)

(73) Assignee: Thomson Licensing, Boulogne Billancourt (FR)

( * ) Notice: Subject to any disclaimer, the term of this patent is extended or adjusted under 35 U.S.C. 154(b) by 403 days.

(21) Appl. No.: 10/528,853

(22) PCT Filed: Sep. 18, 2003

(86) PCT No.: PCT/EP03/50639

§ 371 (c)(1),
(2), (4) Date: Oct. 4, 2005

(87) PCT Pub. No.: WO2004/034418

PCT Pub. Date: Apr. 22, 2004

(65) Prior Publication Data

US 2006/0138959 A1 Jun. 29, 2006

(30) Foreign Application Priority Data

Sep. 27, 2002 (FR) ..... 02 12931

(51) Int. Cl.
*H01J 17/49* (2006.01)

(52) U.S. Cl. ..... 313/586; 313/587

(58) Field of Classification Search ..... 313/582–587
See application file for complete search history.

(56) References Cited

U.S. PATENT DOCUMENTS 5,701,056 A * 12/1997 Shinohara ..... 313/584
6,023,130 A * 2/2000 Sakasegawa et al. ..... 313/582
6,611,099 B1 * 8/2003 Murata et al. ..... 313/582
6,888,310 B2 * 5/2005 Tadaki et al. ..... 313/586
7,034,443 B2 * 4/2006 Ahn et al. ..... 313/292
7,291,978 B2 * 11/2007 Rhee ..... 313/586

FOREIGN PATENT DOCUMENTS

JP 07262930 10/1995
JP 09102280 5/1997

(Continued)

OTHER PUBLICATIONS

Patent Abstracts of Japan, vol. 2000, No. 14, Mar. 5, 2001 & JP 2000/306517 (See Ref. AA).

(Continued)

*Primary Examiner*—Nimeshkumar D. Patel
*Assistant Examiner*—Anthony Perry
(74) *Attorney, Agent, or Firm*—Joseph J. Laks; Harvey D. Fried; Patricia Verlangieri

(57) ABSTRACT

Panel comprising an array of barrier ribs each having a base resting on a plate and a top in contact with another plate that includes at least two arrays of coplanar electrodes each preferably having a constant width. According to the invention, these barrier ribs have, at their top, a low-permittivity region of thickness greater than 3 μm and less than or equal to one fifth of their total height, which has a mean dielectric permittivity at least three times smaller than the dielectric permittivity of these barrier ribs measured at their base. Thanks to the invention, the confinement of the plasma discharges far from the barrier ribs is substantially improved.

10 Claims, 5 Drawing Sheets

FOREIGN PATENT DOCUMENTS

| | | |
|---|---|---|
| JP | 11120923 | 4/1999 |
| JP | 2000/306517 | 11/2000 |
| JP | 2001/035385 | 2/2001 |

OTHER PUBLICATIONS

Patent Abstracts of Japan, vol. 2000, No. 19, Jun. 5, 2001 & JP 2001/035385 (See Ref. AB).

Patent Abstracts of Japan, vol. 1999, No. 09, Jul. 30, 1999 & JP 11-120923 (See Ref. AC).

Patent Abstracts of Japan, vol. 1997, No. 8, Aug. 29, 1997 & JP 09-102280 (See Ref. AD).

Patent Abstracts of Japan, vol. 1996, No. 2, Feb. 29, 1996 & JP 07-262930 See Ref. AE).

Search Report Dated Jan. 23, 2004.

* cited by examiner

PLASMA DISPLAY PANEL HAVING COPLANAR ELECTRODES WITH CONSTANT WIDTH

This application claims the benefit, under 35 U.S.C. §365 of International Application PCT/EP03/50639, filed Sep. 18, 2003, which was published in accordance with PCT Article 21(2) on Apr. 22, 2004 in French and which claims the benefit of French patent application No. 0212931, filed Sep. 27, 2002.

BACKGROUND OF THE INVENTION

The invention relates to a plasma display panel comprising, as shown in FIGS. 1A, 1B, a first plate 11 and a second plate 12 leaving between them a space filled with a discharge gas and compartmentalized into a number of discharge cells 18 arranged in rows and columns, which also includes an array of insulating barrier ribs comprising barrier ribs 15 each separating two adjacent columns of cells, the first plate including at least two arrays of coplanar electrodes Y, Y' called sustain electrodes, which are oriented in general directions that are parallel to one another and perpendicular to said barrier ribs, having a constant width perpendicular to these general directions, and are arranged in such a way that each discharge cell is traversed by an electrode of each array.

Since the barrier ribs 15 each separate two adjacent columns of cells, these barrier ribs are called column barrier ribs, as opposed to row barrier ribs described later.

Each discharge cell is therefore traversed by a pair of sustain electrodes and each pair of sustain electrodes therefore supplies a row of discharge cells; all the adjacent cells of any one row are separated by a column barrier rib made of insulating material; in this way, in the general direction of the coplanar electrodes, the widths of the various cells in any one row are limited by these column barrier ribs. These barrier ribs generally serve as spacers between the plates of the panel.

The coplanar electrodes are covered with a dielectric layer 13 which is itself coated with a protective/secondary-electron-emissive layer 14, generally based on magnesia.

The second plate includes a third array of electrodes X called address electrodes, each placed between two column barrier ribs. Thus, each address electrode therefore supplies a column of discharge cells. These address electrodes may also be covered with a dielectric layer 17.

The array of barrier ribs in certain panels of the prior art also include barrier ribs 16 called row barrier ribs each separating two adjacent rows of cells, in such a way that each cell of the panel is therefore bounded, over its entire perimeter, by barrier ribs as shown in FIGS. 1A, 1B.

The operation of driving the plasma panels conventionally includes address periods intended to activate those cells that have to be turned on, followed by sustain periods during which series of sustain voltage pulses are applied between the sustain electrodes Y, Y' supplying a row of cells, and the gap G separating these electrodes. The amplitude of these sustain pulses must be sufficient to cause discharges in those cells in the row that have been actuated beforehand but insufficient to cause discharges in the cells of this row that have not been activated beforehand.

The addressing of the discharge cells generally takes place between a column electrode and one of the row electrodes, which also serves for sustaining.

The discharge cells and the space between the plates are filled with a low-pressure gas suitable for obtaining discharges that emit ultraviolet radiation.

The walls of each cell are generally provided with a layer of a phosphor capable of emitting visible radiation, especially in the red, green or blue, when it is excited by the ultraviolet radiation of the discharges. These layers are generally deposited on the second plate and on the side walls of the barrier ribs.

In the case of panels emitting three primary colors, namely red, green and blue, these adjacent discharge cells have phosphors of different colors so that discharges emitting indirectly in the red, the green and the blue are obtained.

It is in general the first plate, the one bearing the coplanar electrodes, which serves as the front plate turned toward the person observing the images that the panel is capable of displaying. To prevent the electrodes of the front plate absorbing too great a portion of the visible radiation coming from the cells, the coplanar electrodes are preferably made of a material that is both conductive and transparent, such as tin oxide or mixed indium tin oxide (ITO); as these transparent electrodes are not in general conductive enough, the arrays of transparent electrodes are generally "duplicated" with opaque metal conductors, called "bus conductors" since they distribute the electrical discharge current to the transparent electrodes. Conventionally, the linear electrical conductivity of the bus is greater than that of the initiating conductor. The bus is made of a highly conductive metallic material, such as silver, and consequently it is opaque to light.

During a sustain period, when an electrical voltage pulse of sufficient amplitude is applied between two coplanar electrodes Y, Y' of any one pair, in a cell supplied via these electrodes and activated beforehand during an address period, a discharge is initiated in the gap G near the initiation edge 191 of one of these electrodes, over a front that extends between the column barrier ribs 15 that define, widthwise, this cell at this point. As shown in FIG. 1A, the discharge is initiated in this cell in an initiation region $Z_a$ of the portion of this electrode that corresponds to this cell. It is preferable for the surface potential properties of the dielectric layer 13 coating this electrode to be sufficiently uniform to allow initiation of the discharge at low voltage. After initiation, the discharge spreads out perpendicular to the general direction of the coplanar electrodes as far as the end-of-discharge edge 192 of the electrode, on the opposite side from the initiation edge. The phase during which the discharge spreads out, called the expansion phase, allows the formation of a discharge region with a low electric field, this being very effective for exciting the gas and producing ultraviolet photons. The expansion phase therefore improves the luminous efficiency of the discharges. During the expansion phase, when the discharge expands up to the end-of-discharge edge of the electrode, the discharge occupies almost all of the gas space bounded by the two column barrier ribs 15 that define the width of the cell.

During a sustain period, immediately before an electrical voltage pulse has been applied between two coplanar electrodes Y, Y' of any one pair traversing a cell, the dielectric layer region that covers these electrodes is generally covered with residual charges called "memory charges", coming in particular from the previous discharge in that cell. Immediately at the start of application of an electrical voltage pulse and before any new discharge, the discharge gas region lying between these two electrodes is then subjected to the sum of the voltage applied between these electrodes and of the voltage resulting from the memory charges coming from the previous sustain pulse.

FIG. 3 shows, at the start of a sustain voltage pulse of 100 V amplitude applied to the electrodes, which follows from other identical AC pulses that have left memory charges, the distribution of the equipotential voltage lines in a cross section on A1-A1' of the discharge expansion region, between the middle of a column barrier rib 15 and the middle of the cell, this range corresponding to half the distance between the centers of two adjacent column barrier ribs, that is to say the half-width of a discharge cell. The equipotential lines, shown as continuous lines, correspond to positive values of the potential while the equipotential lines shown as broken lines correspond to negative values of the potential. The potential difference between two adjacent equipotential curves is constant and suitable for obtaining twenty "positive" equipotential curves shown as continuous lines. During the initiating 100 V voltage pulse, it is assumed here that the electrode in question, Y, acts as cathode and that the negative memory charges stored in this cell on the surface of the dielectric layer 13 come from the discharge generated by the previous sustain voltage pulse of the same series, but of opposite sign. In this figure, the equipotential curve V corresponds to the first negative equipotential (shown in broken lines, as opposed to the continuous lines of the positive equipotentials) and indicates the presence of a negative charge deposited at this point on the surface of the column barrier rib 15. The distribution of this equipotential depthwise in the column barrier rib indicates that, after initiation caused by the pulse in question, the discharge will spread out over the side walls of the barrier ribs, and therefore beyond the surface of the dielectric layer 13 and the protection layer 14 covering the electrode Y. During sustain periods in which the panel emits light, the barrier ribs will therefore be in substantial contact with the discharges. This phenomenon results in bigger losses of the charged species on the barrier ribs and to accelerated deterioration of the phosphor material covering these barrier ribs with, as a consequence, a reduction in the luminous efficiency and a reduction in the lifetime of the panel.

The prior art, illustrated for example by document EP 0 782 167 (PIONEER), proposes a solution to this problem that is shown in FIG. 2. FIG. 2 shows a schematic top view of the structure of a cell of a coplanar plasma display panel that differs from the structure shown previously in FIGS. 1A and 1B in that the coplanar electrodes no longer extend over the entire width of the cells. Each electrode Y includes a continuous conductive bus $Y_b$ at the end-of-discharge edge 192 that traverses all the cells of any one row and, in each cell, an electrode element $Y_p$ in the form of a tongue centered on this cell, having a width smaller than this cell and extending from the bus as far as the initiation edge 191. The electrode elements $Y_p$ of each cell are sized in such a way that their lateral edges are positioned at a non-zero distance D from the surface of the closest column barrier ribs 15 that define this cell.

Such a structure applied to the coplanar electrodes Y, Y' makes it possible to reduce the potential on the side walls of the column barrier ribs and on the surface portions of the protective layer that are close to these barriers along the lateral edges of the electrode elements $Y_p$, as illustrated in FIG. 4, which shows the distribution of the electrical equipotential curves in the cell shown in FIG. 2, in a cross section on A2-A2' in the mid-width of the cell, and of the same assumptions and conventions as for FIG. 3 described above. This FIG. 4 indicates that the first negative equipotential curve, shown in broken lines, meets the V-shaped column barrier rib at the top of this rib, at the interface with the protective layer and the dielectric layer 13.

It follows from these dielectric properties, illustrated by the equipotential curves, that there is better confinement of the sustain discharges away from the column barrier ribs at the start of expansion in the panels described in document EP 0 782 167 or, with reference to FIG. 2, relative to the panels described previously with reference to FIGS. 1A and 1B. Thus, the luminous efficiency and the lifetime are improved.

However, at the end of expansion of the discharges, that is to say at the buses $Y_b$ of the coplanar electrodes, the same problem as previously is encountered since the electrodes extend at this point over the entire width of the cells. The potential along the barrier rib surface and the surface of the protective layer remains high near the electrode portions $Y_b$ corresponding to the buses. The improvement in luminous efficiency and in lifetime therefore remains limited.

Furthermore, such a structure having electrode elements is more difficult to produce than that of FIGS. 1A and 1B and requires an expensive operation of horizontal alignment of the plates 11 and 12 so that the electrode elements specific to each cell are perfectly centered on each cell and equidistant from two adjacent column barrier ribs.

SUMMARY OF THE INVENTION

The object of the invention is to increase the luminous efficiency of plasma panels and their lifetime by avoiding these limitations and these drawbacks.

For this purpose, the subject of the invention is a plasma display panel comprising a first plate and a second plate leaving between them a space filled with a discharge gas and partitioned into a number of discharge cells that are arranged in rows and columns, which also includes an array of insulating barrier ribs comprising barrier ribs each separating two adjacent columns of cells and each having a base resting on the said second plate and a top in contact with the said first plate, this first plate including at least two arrays of coplanar electrodes Y,Y' called sustain electrodes, which are oriented along general directions that are parallel to one another and to the said rows, which are placed so that each discharge cell is traversed by an electrode of each array, therefore forming a pair, and which have edges called initiation edges which face one another on either side of the gap separating the electrodes of each pair, characterized in that each column separation barrier rib comprises, at its top and over its entire width, a succession of low-permittivity regions that extend at least on each side of the gap separating the electrodes of each pair, at least starting from a line located 80 μm to the rear of the initiation edges of the electrodes of this pair, and which have a thickness of greater than 3 μm but not exceeding one fifth of the total height of the said barrier ribs, and a mean dielectric permittivity at least three times smaller than the dielectric permittivity of the said barrier ribs measured at their base.

The low-permittivity regions thus extend over at least each side of the gap of each cell.

The thickness of a low-permittivity region on a barrier rib is measured from the top of this rib in contact with the first plate. Each of these regions extends approximately over the entire width of the barrier rib to within the thickness of any phosphor layer.

If the coplanar electrodes not of constant width, for example as in the structure of the prior art described with reference to FIG. 2, the invention then makes it possible to combine the efficiency advantages already described in this structure with those specific to the invention described below.

The invention applies especially to cases in which the coplanar electrodes each have a constant width over their entire useful length. The term "useful length" of an electrode is understood to mean the length corresponding to all of the cells served by this electrode. The width of this electrode is understood to mean the width measured perpendicular to its general direction. Since the width of the coplanar electrodes is constant in the structure of the prior art described with reference to FIGS. 1A and 1B, the arrays of electrodes are less expensive to produce and the operation of assembling the plates is not penalized by alignment constraints. Thus, the drawbacks of the structure of the prior art described with reference to FIG. 2 are avoided, while obtaining at least equivalent if not better advantages from the standpoint of luminous efficiency and lifetime, as will be explained below.

The invention specifically aims to modify the distribution of the equipotential curves not by modifying the shape and position of the electrodes in each cell, as described previously with reference to FIGS. 2 and 3, but by varying the dielectric permittivity within the barrier ribs in a manner suitable for making, in each cell, the equipotential curves near the dielectric layer and the protective layer closer together and so as to reduce the electrical potential on the side walls of these barrier ribs, especially near these layers.

Thanks to the thickness specific to the invention of the low-permittivity regions and thanks to the mean dielectric permittivity specific to the invention of these regions, there is therefore better confinement of the sustain discharges over the surface of the dielectric layer and of the protective layer, away from the barrier ribs, thereby reducing the loss of charged species from the plasma and the degradation of the phosphors on these barrier ribs by the plasma in the discharge expansion region.

An additional advantage of the structure of the panel according to the invention results from obtaining the desired confinement of the discharges even at the end of expansion. Unlike the structure described with reference to FIG. 2, the potential on the side walls of the barrier ribs and at the surface of the protective layer and of the dielectric layer is also lowered near the electrode portions corresponding to the end of discharge. This allows even greater improvement in the luminous efficiency and the lifetime.

If the first plate has three arrays of electrodes, each cell is then traversed by three electrodes, one from each array, which then form a triad.

The term "gap" is understood to mean the region that separates the electrodes of each pair or, as the case may be, the regions separating the electrodes of each triad. When the width of the coplanar electrodes is constant, the width of the regions separating the electrodes is also constant.

The low-permittivity region located at the top of the barrier ribs may therefore be discontinuous, that is to say it may be interrupted at the gap separating the coplanar electrodes of each pair by up to 80 μm at most on either side of the electrode edges, beyond this gap. The low-permittivity regions then extend on each side of the gap, especially in the discharge expansion regions, that is to say facing the surface of the electrodes. The low-permittivity region may extend further, for example when it is interrupted exactly at the gap separating the coplanar electrodes.

According to a simpler variant, which is less expensive to manufacture, the succession of low-permittivity regions at the top of each barrier rib forms a continuous low-permittivity region, with no interruption at the gaps.

According to another variant allowing better control of the discharge confinement and greater improvement in the luminous efficiency and the lifetime, at the top of each barrier rib separating two columns, the low-permittivity regions are discontinuous and interrupted at the gap separating the electrodes of each pair.

In summary, the subject of the invention is a plasma display panel comprising an array of barrier ribs each having a base resting on a plate and a top in contact with another plate that includes at least two arrays of coplanar electrodes, characterized in that these barrier ribs have, at their top, a low-permittivity region with a thickness of greater than 3 μm not exceeding one fifth of their total height, which has a mean dielectric permittivity at least three times smaller than the dielectric permittivity of these barrier ribs measured at their base.

To further improve the confinement of the sustain discharges far from the side walls of the barrier ribs, the invention may also have one or more of the following features:

- the thickness of said low-permittivity regions is at least equal to 5 μm;
- the column separating ribs furthermore have high-permittivity intermediate regions that are intermediate between the base of the barrier ribs and said low-permittivity regions and which have a thickness greater than the thickness of the low-permittivity regions and a mean dielectric permittivity greater than the dielectric permittivity of these barrier ribs measured at their base. Preferably, the mean dielectric permittivity of these high-permittivity intermediate regions is not less than five times the dielectric permittivity of the barrier ribs measured at their base. The succession of high-permittivity intermediate regions may form continuous intermediate region of high permittivity. In contrast, at the top of each barrier rib, the high-permittivity regions may be discontinuous and interrupted at the gap separating the electrodes of each pair.

The invention may furthermore include one or more of the following features:

- the general directions of the coplanar electrodes are perpendicular to the column separating ribs;
- the coplanar electrodes Y,Y' are coated with a dielectric layer and with a protective/secondary-electron-emissive layer generally based on magnesia;
- the second plate includes a third array of electrodes X called address electrodes, each placed on a column of cells;
- the array of barrier ribs also includes barrier ribs each separating two adjacent rows of cells; and
- the barrier ribs have a height of at least 100 μm.

Documents JP 2000-306517 and JP 07-262930 (see 2nd embodiment associated with FIG. 3 of this document) disclose plasma panels in which it is the dielectric layer positioned on the first plate that has low-permittivity regions. In document JP 07-262930, these regions are located between the rows of cells and not between the columns, as in the invention. Such regions make it possible to limit the expansion of the discharges in the vertical direction of the columns, whereas the invention makes it possible also to limit the expansion of the discharges in the horizontal direction of the rows. In these two documents, these regions extend continuously over the entire width or over the entire useful height of the panel and may be in contact with the top of the barrier ribs separating the columns (FIG. 1 of document JP 2000-306517). It should be noted that such low-permittivity regions are particularly difficult to produce in the thickness of the dielectric layer, whereas the low-permittivity regions according to the invention are much easier to produce at the top of the barrier ribs.

BRIEF DESCRIPTION OF THE DRAWINGS

The invention will be more clearly understood on reading the description that follows, given by way of non-limiting example and with reference to the appended figures in which.

The figures have not been drawn to scale to as to better reveal certain details that will not be clearly apparent if the proportions had been respected.

To simplify the description and to bring out the differences and advantages that the invention affords over the prior art, identical references are used for the elements that provide the same functions.

DESCRIPTION OF PREFERRED EMBODIMENTS

Figure 1A:
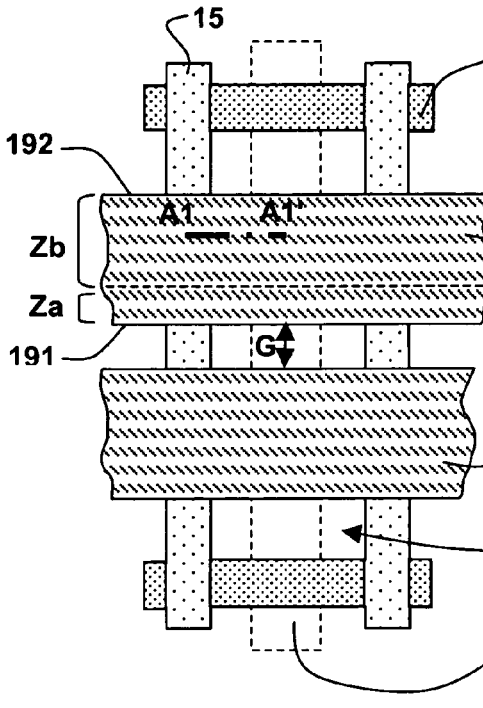
FIGS. 1A and 1B, already described, show a top view and a longitudinal section respectively, of a cell with coplanar electrodes of constant width of a plasma panel according to the prior art.
Figure 1B:
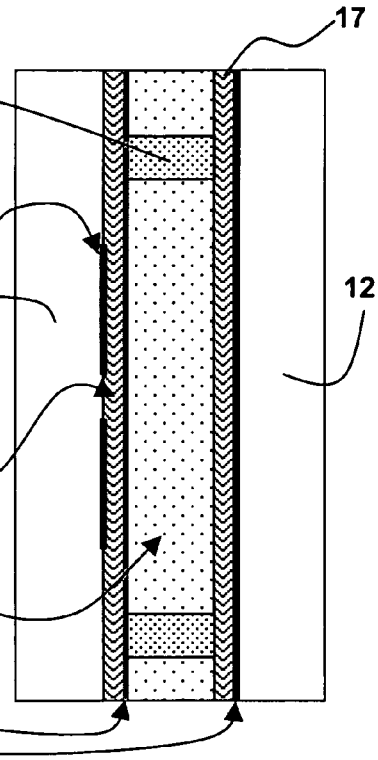

According to the first embodiment of the invention shown in FIG. 5, the plasma panel includes the same elements arranged in the same structure as the panel of the prior art described with reference to FIGS. 1A and 1B, the only difference being that the column barrier ribs 15 include a base layer 15*a* in contact with the dielectric layer 17 covering the array of electrodes X of the second plate 12, and a continuous top layer 15*b* that is applied to the base layer 15*a* and extends as far as the dielectric layer 13 and the protective layer 14 covering the arrays of coplanar electrodes Y, Y' of the first plate 11. Here, the coplanar electrodes each have a constant width over their entire useful length, and the electrode arrays are less expensive to produce and the operation of assembling the plates is not penalized by alignment constraints.

According to this embodiment, the thickness or height $D_a$ of the base layer and the mean dielectric permittivity $E_a$ of its constituent material, on the one hand, and the thickness or height $D_b$ of the top layer and the mean dielectric permittivity $E_b$ of its constituent material, on the other hand, are adapted so that $E_a$ is greater than $E_b$ and for $D_a$ to be greater than $D_b$, preferably so that $E_a \geqq 3E_b$ and that $D_a \geqq 4D_b$. The top layer therefore corresponds to a continuous low-permittivity region of the barrier ribs. The thickness of the top layer thus represents at most one fifth of the total height of the barrier ribs. To obtain a significant confinement effect, it is necessary for the thickness of this layer to be greater than 3 μm.

As this first embodiment of the invention illustrates, the principle of the invention therefore consists in substantially lowering the capacitance of the column barrier ribs near their top, here over a small portion $D_b$ of the height of these ribs, that is to say near the protective layer 14 and the dielectric layer 13, over which layers the sustain discharges spread out, so that the electrical capacitance is very low in the upper portion of these barrier ribs in contact with the coplanar plate 11 and so that it is higher in the other portion of these barrier ribs. This nonuniformity in electrical capacitance of the barrier ribs specific to the invention allows the equipotential lines in the low-capacitance region located near the surface of the dielectric layer and the protective layer covering the coplanar electrodes of the plate 11 to be closer together, and therefore the spreading of the sustain discharges over the dielectric surface are better confined, without "spilling over" onto the side walls of the barrier ribs. The smaller the height $D_b$ of the top layer compared with the height of the base layer $D_a$ and the lower the mean dielectric permittivity $E_b$ of the top layer compared with the mean dielectric permittivity $E_a$ of the base layer, the lower the electrical potential on the discharge spreading surface near these barrier ribs, by the capacitive divider effect resulting from the bilayer structure, described above, of the barrier ribs.

Figure 2:
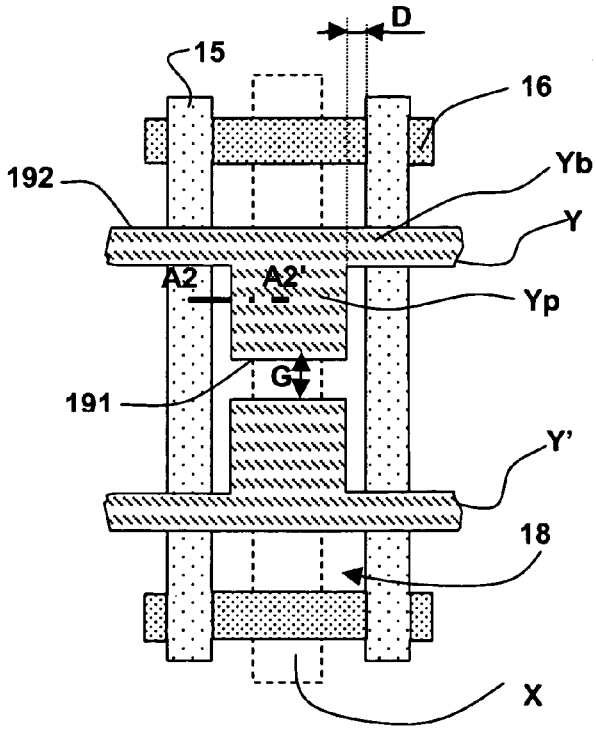
FIG. 2, already described, shows a top view of a cell with coplanar electrodes of variable width of a plasma panel according to the prior art.
Figure 3:
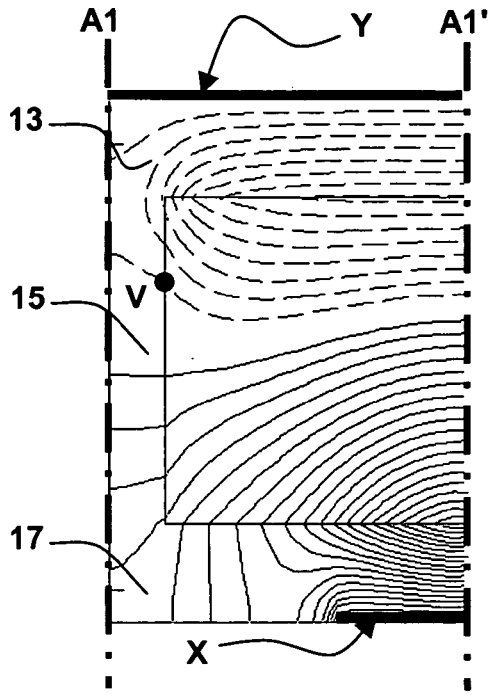
FIGS. 3 and 4, already described, show the potential distribution in a cross section on A1-A'1 of one half of a cell of FIG. 1A and in a cross section on A2-A'2 of one half of a cell of FIG. 2, respectively, at the start of the application of a 100 V voltage pulse to the coplanar electrode of this cell half.
Figure 4:
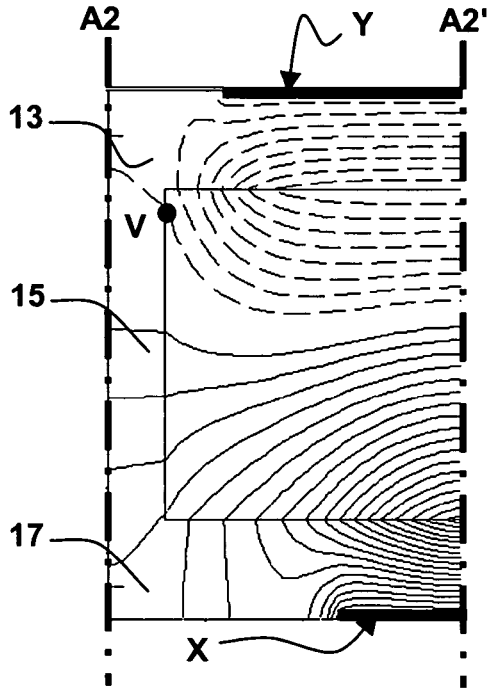
Figure 6:
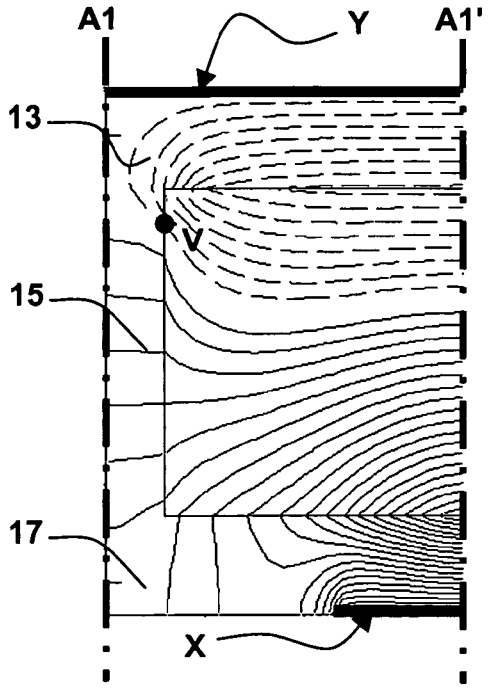
FIGS. 6 and 7 show two examples of the potential distribution that is obtained in a cross section on A1-A'1 in the half of a cell shown in FIG. 5, using the same conventions as in the case of FIGS. 3 and 4.

FIG. 6 shows the distribution of the equipotential lines obtained on this spreading surface using a discharge cell structure according to the first embodiment that has just been described, with $E_a=3E_b$ and $D_a=4D_b$, when a 100 V voltage pulse is applied to the electrode Y and when this electrode acts as cathode for this pulse. This distribution corresponds to the potential distribution at the start of application of the pulse, before initiation of the discharge, under the same assumptions and conventions as in the case of FIGS. 3 and 4 described above, the equipotential curves shown as solid lines corresponding to positive potentials and the equipotential curves shown as broken lines corresponding to negative potentials. This FIG. 4 shows that the degree of confinement of the discharges illustrated by the position V of the first negative equipotential, shown in broken lines, is close to the case of the prior art described above with reference to FIGS. 2 and 4, where the coplanar electrodes have elements specific to each cell that are difficult and expensive to produce. Thanks to this confinement, at least a comparable improvement in luminous efficiency and in lifetime of the panel is therefore achieved for a lower cost.

Figure 7:
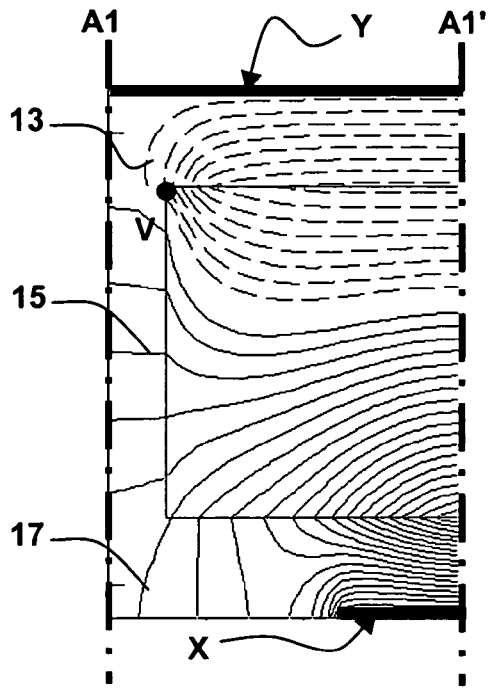

FIG. 7 shows, with the same conventions as in FIG. 6, the distribution of the equipotential lines obtained for a panel according to the first embodiment in which, this time, $E_a=5E_b$ and $D_a=10D_b$. The position V of the first negative equipotential is here coincident with the surface of the dielectric layer and of the protective layer covering the electrode Y. During sustained periods, the discharges therefore longer spread out at all over the side walls of the barrier ribs. This corresponds to the general objective of the invention.

Figure 12:
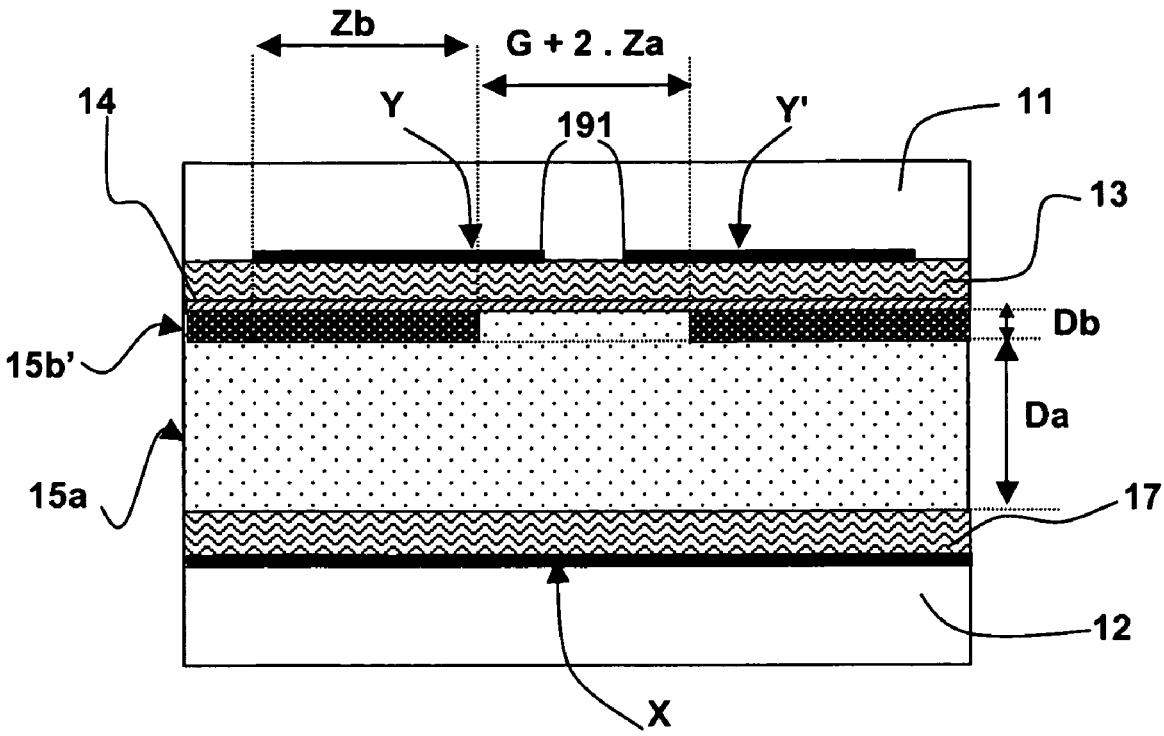
FIG. 12 shows a variant of the first embodiment of the invention of FIG. 5, according to which the top of the barrier ribs includes a low-permittivity region only in the discharge expansion regions.

According to a variant of the first embodiment of the invention shown in FIG. 12, the layer 15*b* of low permittivity $E_b$ is produced at the top of the barrier ribs only near the barrier rib portions that correspond to the discharge expansion region, so that, near the barrier rib portions that correspond to the inter-electrode gap G and near the initiation region, the top of the barrier ribs has a permittivity $E_a$ identical to that of the base layer.

According to this variant, each column separating rib comprises, at its top and over its entire width, a succession of low-permittivity regions 15*b*' that extend on either side of the gap separating the electrodes of each pair from a line located at the boundary between the initiation region $Z_a$ and the expansion region $Z_b$, to the rear of the initiating edges 191 of the electrodes of this pair. Conventionally, this boundary line is separated from the initiating edge by at most 80 μm. In other words, the width of the initiation region $Z_a$ is at most 80 μm. These low-permittivity regions have the same thickness and the same dielectric permittivity as the low-permittivity region described above.

As the discharge initiating region is separated from the low-permittivity barrier rib region, a more uniform electric field over the entire length of the initiating edges 191 of the electrodes is therefore advantageously obtained. This advantageously makes it possible to obtain the same ignition properties as in the panels of the prior art described above. In the discharge expansion regions, in which the side walls of the barrier ribs run the risk of being subjected to charged particles from the discharges, the low-permittivity regions 15*b*' according to the invention allow the discharges to be confined, as described above, according to the objective of the invention.

Figure 5:
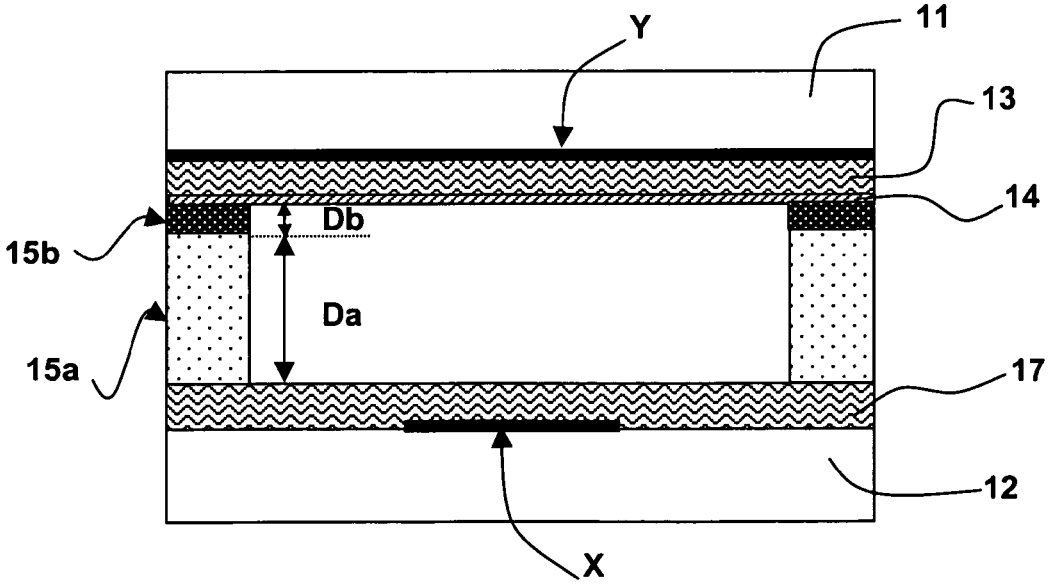
FIG. 5 shows a cross-sectional view of a cell of a plasma panel according to a first embodiment of the invention.
Figure 8:
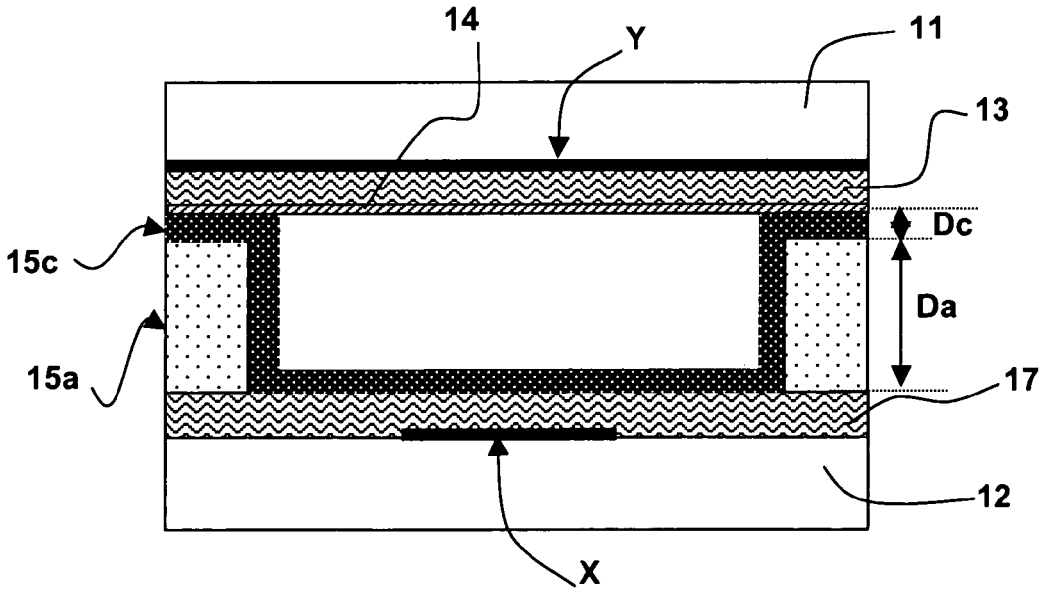
FIG. 8 shows a cross sectional view of a cell of a plasma panel according to a second embodiment of the invention.
Figure 9:
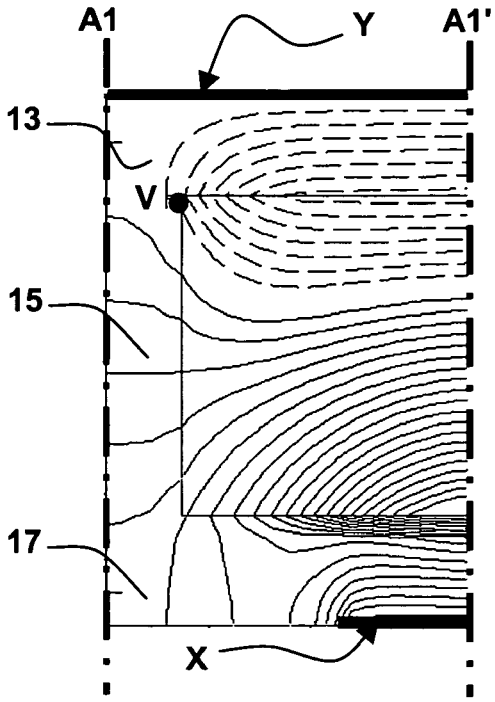
FIGS. 9 and 10 show the potential distribution as obtained in a cross section on A1-A'1 in the half of a cell shown in FIG. 8 and in a cross section on A1-A'1 in the half of a cell shown in FIG. 11 respectively, again using the same conventions as in FIGS. 3 and 4.

FIG. 8 illustrates, compared with FIG. 5, a second embodiment of the invention in which the barrier ribs include a continuous upper layer 15*c* similar to the top layer 15*b* described above. This top layer 15*c* also has a low thickness $D_c$ and a low permittivity $E_c$. This top layer $\mathbf{15}_c$ not only covers, as previously, the top of the barrier ribs but extends here, continuously over the entire active surface of the second plate 12. Such a configuration is advantageously easier to produce than that described above, for example using a screen-printing method for depositing said top layer. Taking $E_a=5E_c$ and $D_a=5D_c$ and under the same conditions as previously, a surface potential distribution as shown in FIG. 9 is obtained. This figure shows that the discharge confinement effect obtained is quite comparable to that obtained with the embodiment described with reference to FIG. 7. By comparing FIGS. 7 and 9, it may be seen that replacing a top layer of the barrier ribs with a continuous upper layer coating the entire second plate does not appreciably modify the distribution of the equipotential lines so that again the benefits of the invention are obtained.

According to this embodiment, the thickness or height $D_a$ of the base layer and the mean dielectric permittivity $E_a$ of its constituent material, on the one hand, and the thickness or height $D_c$ of the top layer and the mean dielectric permittivity $E_c$ of its constituent material, on the other hand, are adapted so that $E_a$ is greater than $E_c$ and so that $D_a$ is greater than $D_c$, preferably so that $E_a \geqq 3E_c$ and so that $D_a \geqq 4D_c$. The top layer therefore corresponds to a low-permittivity region of the barrier ribs. The thickness of the top layer thus represents at most one fifth of the total height of the barrier ribs. To obtain a significant confinement effect, it is necessary for the thickness of this layer to be greater than 3 μm.

In the case of the first and second embodiments, the low-permittivity region $\mathbf{15}_b$ or $\mathbf{15}_c$ may for example be formed by a porous layer of aluminum oxide, the remainder of the barrier ribs namely, in this case, the base layer 15*a* of higher permittivity being, for example, formed from a vitreous layer of lead oxide.

Figure 11:
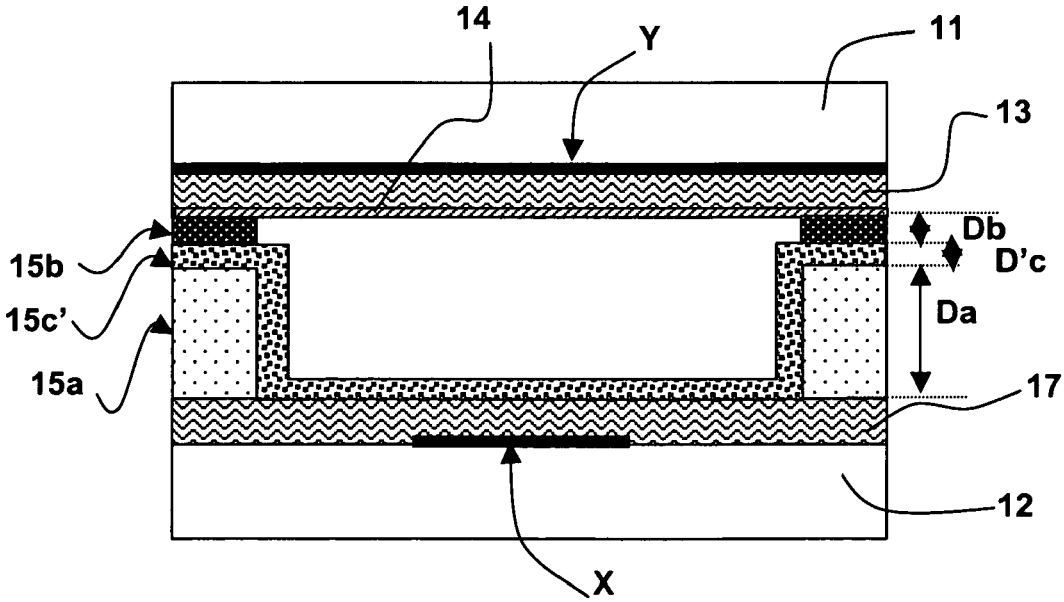
FIG. 11 shows a cross section of a cell of a plasma panel according to a third embodiment of the invention.

FIG. 11 shows a third embodiment of the invention, which combines the first and second embodiments described above. The barrier ribs therefore have three superposed layers, namely a first, base layer 15*a* of thickness $D_a$ and relative permittivity $E_a$ resting on the dielectric layer 17 covering the array of electrodes X of the second plate 12, a second layer 15*c*' of thickness $D'_c$ and relative permittivity $E'_c$ covering the entire second plate 12, as in the second embodiment, and a third layer 15*b* of thickness $D_b$ and of relative permittivity $E_b$ covering only the top of the barrier ribs, as in the first embodiment.

Furthermore according to this third embodiment, $E'_c>E_a>E_b$ and $D_a>D'_c \geqq D_b$. Preferably, $E'_c>5E_a$ and $E_a \geqq 3E_b$, with $D_a \geqq 4D'_c$ and $D'_c \geqq D_b$.

Apart from a low-permittivity region at the top of the barrier ribs, as in the first and second embodiments, is therefore here a high-permittivity region inserted between the base of the barrier ribs and this low-permittivity region.

Figure 10:
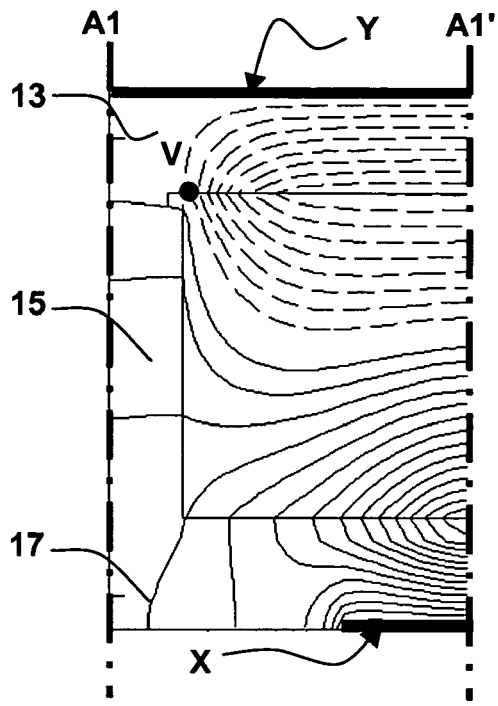

In comparison with the first and second embodiments of the invention, the insertion, into the barrier ribs, of a high-permittivity intermediate region, namely the second layer 15*c*', allows the equipotential lines in the barrier rib region corresponding to the first layer 15*a* and to the second layer 15*c*' to be moved further apart, in such a way that the equipotential lines in the third layer 15*b* are even more closely spaced than previously, thereby improving the confinement of the discharges. $E_b=E_a/5$, $E'_c=5E_a$ and $D_b=D'_c=D_a/5$, the distribution of the equipotential lines illustrated in FIG. 10, over the half-width of a discharge region, with the same conventions as previously, is then obtained.

In this third embodiment, the low-permittivity third layer 15*b* may for example be a porous layer of aluminum oxide, the first layer 15*a* of higher permittivity may be a vitreous layer of lead oxide and the second layer 15*c*', corresponding to the low-permittivity intermediate region, may for example be a layer based on $TiO_2$ or $BaTiO_3$.

To produce a panel according to the invention in any one of the embodiments that have just been described, suitable materials and methods known per se to those skilled in the art of plasma panels will be used.

To operate the plasma panel thus obtained, it is conventional to use a standard plasma panel supply and drive system.

The invention claimed is:

1. A plasma display panel comprising a first plate and a second plate leaving between them a space filled with a discharge gas and partitioned into a number of discharge cells that are arranged in rows and columns, which also includes an array of insulating barrier ribs comprising barrier ribs each separating two adjacent columns of cells and each having a base resting on the said second plate and a top in contact with the said first plate, this first plate including at least two arrays of coplanar electrodes called sustain electrodes, which are oriented along general directions that are parallel to one another and to the said rows, which are placed so that each discharge cell is traversed by an electrode of each array, therefore forming a pair, and which have edges called initiation edges which face one another on either side of the gap separating the electrodes of each pair, wherein each column separation barrier rib comprises, at its top and over its entire width, a succession of low-permittivity regions that extend at least on each side of the gap separating the electrodes of each pair, at least starting from a line located 80 μm to the rear of the initiation edges of the electrodes of this pair, and which have a thickness of greater than 3 μm but not exceeding one fifth of the total height of the said barrier ribs, and a mean dielectric permittivity at least three times smaller than the dielectric permittivity of the said barrier ribs measured at their base.

2. The panel as claimed in claim 1, wherein said coplanar electrodes each have a constant width over their entire useful length.

3. The panel as claimed in claim 1, wherein the succession of low-permittivity regions at the top of each barrier rib forms a continuous low-permittivity region.

4. The panel as claimed in claim 1, wherein, at the top of each barrier rib separating two columns, the low-permittivity regions are discontinuous and interrupted at the gap separating the electrodes of each pair.

5. The panel as claimed in claim 1, wherein the thickness of said low-permittivity regions is at least equal to 5 μm.

6. The panel as claimed in claim 1, wherein said column separating ribs furthermore have high-permittivity intermediate regions that are intermediate between the base of the barrier ribs and said low-permittivity regions and which have a thickness greater than the thickness of said low-permittivity regions and a mean dielectric permittivity greater than the dielectric permittivity of said barrier ribs measured at their base.

7. The panel as claimed in claim 1, wherein said coplanar electrodes are coated with a dielectric layer and a protective/secondary-electron-emissive layer.

8. The panel as claimed in claim 1, wherein said second plate includes a third array of electrodes called address electrodes, each placed on a column of cells.

9. The panel as claimed in claim 1, wherein said array of barrier ribs also includes barrier ribs each separating two adjacent rows of cells.

10. The panel as claimed in claim 1, wherein said barrier ribs have a height of at least 100 μm.

* * * * *